United States Patent [19]

Valteris et al.

[11] Patent Number: 4,631,018

[45] Date of Patent: Dec. 23, 1986

[54] PLATE, FOAM AND SCREEN FILAMENT QUENCHING APPARATUS

[75] Inventors: Ramunas L. Valteris, Seaford; Gary L. Caldwell, Wilmington, both of Del.

[73] Assignee: E. I. Du Pont de Nemours and Company, Wilmington, Del.

[21] Appl. No.: 667,049

[22] Filed: Nov. 1, 1984

[51] Int. Cl.[4] ..... B29C 35/06; B29C 47/88

[52] U.S. Cl. ..... 425/445; 425/72 S

[58] Field of Search ..... 210/500.1, 496, 490, 210/499, 492, 506, 507; 425/72 S, 445

[56] References Cited

U.S. PATENT DOCUMENTS

| | | | |
|---|---|---|---|
| 2,947,029 | 8/1960 | Bakker | 425/72 S |
| 2,982,994 | 5/1961 | Fernstrom | 425/72 S |
| 3,003,643 | 10/1961 | Thomas | 210/506 |
| 3,059,312 | 10/1962 | Jamieson | 210/500.1 |
| 3,067,458 | 12/1962 | Dauchert | 425/72 S |
| 3,067,459 | 12/1962 | Brand | 425/72 S |
| 3,108,322 | 10/1963 | Tate | 425/72 S |
| 3,299,469 | 1/1967 | Charlton | 425/72 S |
| 3,448,186 | 6/1969 | Nicita et al. | 425/72 S |
| 3,619,452 | 11/1971 | Harrison | 425/445 |
| 3,834,847 | 9/1974 | Fletcher | 264/237 |
| 4,285,646 | 8/1981 | Waite | 425/72 S |
| 4,332,764 | 6/1982 | Brayford et al. | 425/72 S |
| 4,492,557 | 1/1985 | Ray et al. | 425/72 S |
| 4,529,368 | 7/1985 | Makansi | 425/72 S |

*Primary Examiner*—Willard E. Hoag

[57] ABSTRACT

An apparatus for quenching synthetic filaments which comprises an elongated chimney, a porous open-celled foam sheet, dividing said chimney longitudinally into a plenum chamber and a quenching chamber through which filaments pass in a path from an extrusion device to a means for collecting filaments and a means to supply a flow of gas to the plenum chamber. The improvement comprises a mesh screen coextensive with the foam sheet positioned between the foam sheet and the quenching chamber.

2 Claims, 2 Drawing Figures

PLATE, FOAM AND SCREEN FILAMENT QUENCHING APPARATUS

BACKGROUND OF THE INVENTION

This invention concerns an apparatus for quenching filaments by directing and distributing the cooling gas entering the quenching area.

In a melt spinning process, filaments are extruded into a quenching chamber where heat is removed from the filaments typically by passing cooling gas, typically air, around the filaments. Makers of synthetic filaments are continually attempting to increase the speeds of their spinning processes and thus the quantity of polymer spun per unit time and also the uniformity of their products. However, melt spinning processes are limited by the rate at which heat can be removed from extruded filaments by cooling air in the quenching chimney. Higher throughputs usually require higher quench air velocities, but turbulence increases as air velocity increases. Turbulence shakes the hot filaments, causing along-end variations in the denier of the filaments, filaments sticking together and filament breaks.

The prior art teaches that the turbulence of the gas stream in the quenching chamber can be reduced by using a number of screen layers of the same or different mesh lying against each other or in combination with perforated plates. The prior art also teaches that the turbulence can be reduced by using an open-cell foam which is dislcosed in U.S. Pat. Nos. 3,834,847 and 3,619,452. While foam alone can satisfactorily reduce cooling gas turbulence under the conditions disclosed in the two patents, further reduction of turbulence becomes necessary in certain situations where an increase in throughput is desired. It is believed that turbulence of air flow through foam occurs because certain passages through the foam permit higher flow rates than adjacent ones and because the air flow at the exit surface is not directed perpendicularly to the surface from all passages. Flows from two or more adjacent passages may merge beyond the exit surface to form streams of considerably higher velocity or volume than neighboring ones.

SUMMARY OF THE INVENTION

The invention comprises an apparatus for the production of a substantially nonturbulent stream of cooling gas for quenching melt extruded synthetic filaments. The apparatus includes an elongated chimney, a porous open celled foam sheet dividing said chimney longitudinally into a quenching chamber through which filaments pass in a path from an extrusion device to a means for collecting filaments and a plenum chamber. A conduit means is connected to said plenum chamber for supplying a flow of gas thereto. The improvement comprises a mesh screen coextensive with the foam sheet, in other words the mesh screen is essentially the same height and width as the foam sheet, and is positioned between the foam sheet and the quenching chamber, thereby permitting the quenching medium to pass into said quenching chamber as a substantially nonturbulent gas. The screen is about 50 to 150 mesh with about 25% to about 50% open area and is comprised of smooth-surfaced metal wires or polymer filaments of substantially uniform cross section. The screen provides openings of uniform size and pressure drop to uniformize the cooling gas flow before it enters the quenching chamber producing a surprising reduction in turbulence and velocity distribution downstream of the assembly. A perforated plate may optionally be provided between the foam sheet and the plenum chamber. The screen is particularly effective at air flow velocities of 1.5 ft. per sec. and greater. "Open-cell foam" signifies foam, either flexible or rigid, wherein cells are inter-connected by passages which permit flow of air through the foam. The screen may either be in contact with the foam or seprated from it.

DETAILED DESCRIPTION OF THE DRAWINGS

Figure 1:
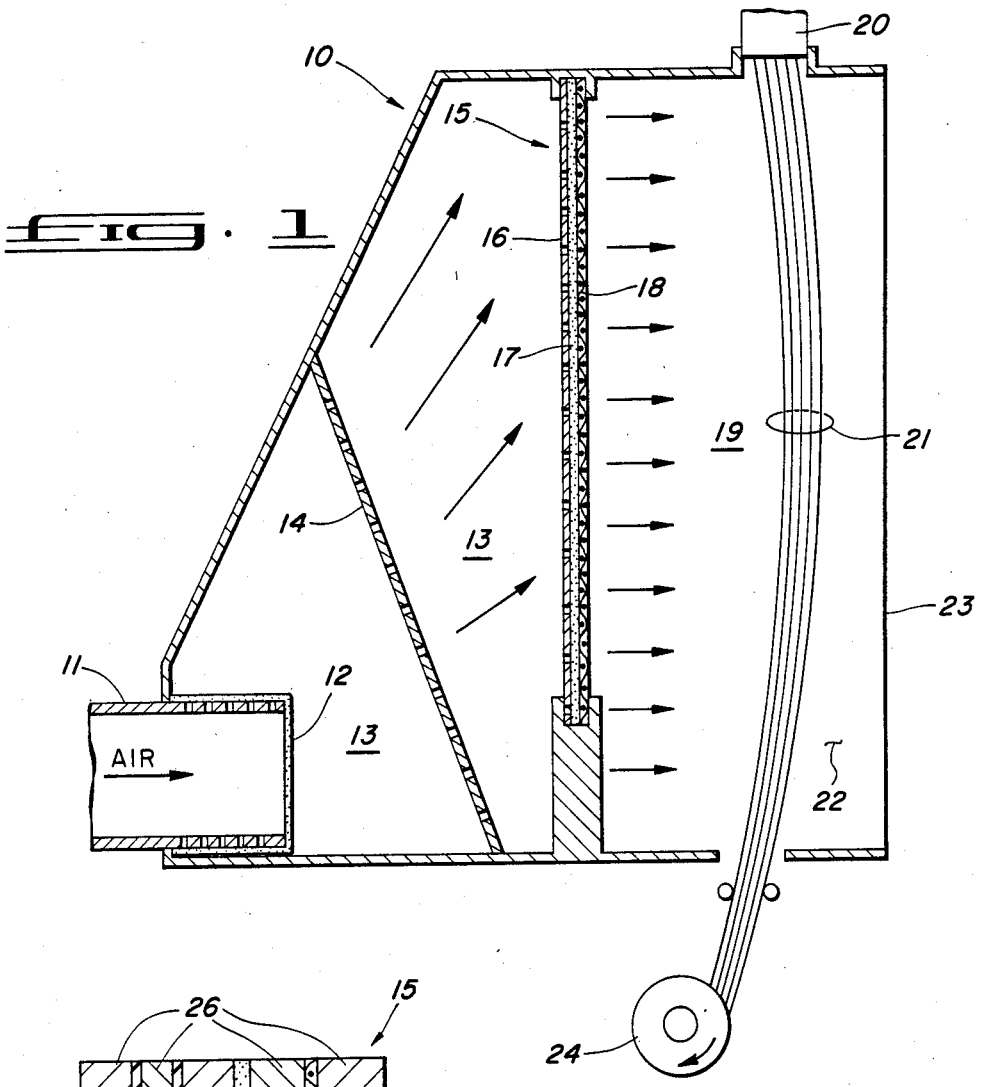
FIG. 1 is a sectional side view of a preferred embodiment of the apparatus of this invention.

FIG. 1 shows a filament quenching chimney 10 of the cross-flow type in which a flow of quench air is supplied from a central manifold through a connecting conduit 11 and passes through the foam covered restrictor 12 which provides a resistance permitting changing of screens without affecting adjacent spinning positions. Quench air passes into plenum chamber 13 and through perforated distribution plate 14 within the plenum chamber 13. Attached to the front of the plenum chamber 13 is rectifier assembly 15 which provides sufficient resistance to flow to uniformly distribute air vertically along and across plenum chamber 13. This rectifier assembly of the present invention includes, successively in the direction of air flow, perforated metal plate 16, open-celled foam 17, and a mesh (50 to 150 mesh) screen 18. Quench air flows through the rectifier assembly 15 into quench chamber 19. Filaments extruded from spinneret 20 are fed downward through quenching chamber 19 as a bundle 21 to a collecting means 24. Quench air confined by wall 22 located on both sides of the filament bundle flows across and through filament bundle 21, exiting the quench chamber at front opening 23.

Figure 2:
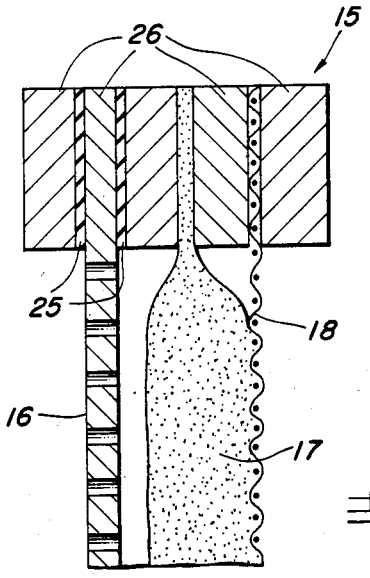
FIG. 2 shows a detail of the screen frame assembly of FIG. 1.

FIG. 2 shows a detailed structure of this invention consisting of the rectifier frame 26 designed to seal around the edges of the perforated plate 16 with suitable gaskets 25, the sheet of porous open-celled foam 17, stretched and clamped between two halves of the frame 26, as well as to stretch the mesh screen 18 into the frame.

TEST METHODS

The turbulence is measured quantitatively by using a constant temperature thermal anemometer (TSI, Inc. model 1050 series) and a hot-film probe (0.002 inch diameter, TSI, Inc.). The linearized output of the anemometer is inputted to an RMS (root-mean-square) voltmeter where a 10 second time-constant mean value of the RMS velocity turbulence is recorded. For the values reported in Table I, separate determinations were made with the hot-film probe held fixed in position at approximately six locations spaced at equal intervals down the length of the rectifier. The probe was held at approximately 2 inches from the rectifier. The value reported in Table I is the average value of those six determinations divided by the average velocity and expressed in terms of percent.

The air velocity distribution is measured quantitatively by using the hot-film anemometer system described above with the linearized output of the anemometer inputted to the Y axis input of a X-Y analog plotter. The X axis input of the X-Y plotter is from the output of a linear position transducer attached to a constant-speed motor-driven traverse system. The hot-film probe is attached to the moveable slide of the traverse system. A measure of the velocity distribution as reported in Table I was determined as follows: the air velocity trace is divided into approximately 6 spans or sections of equal length. The maximum versus minimum velocity differential over a one-half inch length that can be found in each span is determined and the results for the different spans averaged together. This average differential is then divided by the average velocity of the trace and the resulting measure of air velocity distribution is then expressed in terms of percent. Values for the examples are recorded in Table I.

EXAMPLES

Various combinations of rectifier elements are inserted as assembly 15 and the turbulence and distribution are measured as described above. Data are shown in Table I. The perforated plate 16 has holes of 0.062 inches diameter located in a staggered array on 7/32 inch centers, giving 7.4% open area. The foam 17 is a sheet ½" thick having approximately 45 pores per inch. The screen 18 is 100 mesh having about 30.3% open area.

TABLE I

| | PERFORATED PLATE | FOAM | COVER SCREEN | AIR FLOW $\bar{v}$ ft./sec. | TURB.* $v_{RMS.}/\bar{v}$ | DIST.** $\Delta v^{***}/\bar{v}$ |
|---|---|---|---|---|---|---|
| EXAMPLES | | | | | | |
| 1 | None | Yes | Yes | 2.3 | 0.64 | 4.3 |
| 2 | Yes | Yes | Yes | 2.2 | 0.47 | 4.5 |
| COMPARATIVE EXAMPLES | | | | | | |
| a | None | None | None | 2.8 | 15.8 | 79 |
| b | Yes | None | None | 2.2 | 24 | 102 |
| c | None | Yes | None | 2.2 | 1.17 | 16 |
| d | None | None | Yes | 2.3 | 1.01 | 7 |
| e | Yes | None | Yes | 2.3 | 15.5 | 81 |
| f | Yes | Yes | None | 2.2 | 1.17 | 21 |

*TURB.: Turbulence expressed in terms of %.
**DIST.: Air velocity distribution expressed in terms of %
***Δv: The difference between the high and the low air velocity.

We claim:

1. In an apparatus for quenching synthetic filaments which includes: an elongated chimney, a porous open-celled foam sheet, dividing said chimney longitudinally into a plenum chamber and a quenching chamber, through which filaments pass in a path from an extrusion device to a means for collecting filaments and a means to supply a flow of gas to the plenum chamber, the improvement of which comprises: a mesh screen coextensive with the foam sheet positioned between the foam sheet and the quenching chamber wherein the screen is from about a 50 mesh screen to about a 150 mesh screen.

2. The apparatus of claim 1 where a perforated plate is inserted between the foam sheet and the plenum chamber.

* * * * *